US011236653B2

(12) United States Patent
Nathak et al.

(10) Patent No.: US 11,236,653 B2
(45) Date of Patent: Feb. 1, 2022

(54) MULTI-CHAMBERED SOUND ATTENUATION WITH RESONANT FREQUENCY TARGETING

(71) Applicant: Caterpillar Inc., Deerfield, IL (US)

(72) Inventors: Subhro Samarendra Nathak, Peoria, IL (US); Sudhakar Kakani, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 457 days.

(21) Appl. No.: 16/256,722

(22) Filed: Jan. 24, 2019

(65) Prior Publication Data

US 2020/0240299 A1 Jul. 30, 2020

(51) Int. Cl.

| | |
|---|---|
| ***F01N 1/02*** | (2006.01) |
| ***F01N 1/08*** | (2006.01) |
| ***F01N 13/18*** | (2010.01) |

(52) U.S. Cl.

CPC ..... *F01N 1/02* (2013.01); *F01N 1/083* (2013.01); *F01N 13/18* (2013.01); *F01N 2470/02* (2013.01); *F01N 2470/24* (2013.01); *F01N 2490/02* (2013.01); *F01N 2490/15* (2013.01)

(58) Field of Classification Search

CPC ... F01N 1/02; F01N 1/026; F01N 1/08; F01N 1/083; F01N 1/084; F01N 1/089; F01N 2470/00; F01N 2470/02; F01N 2490/00; F01N 2490/02; F01N 2490/06; F01N 2490/08; F01N 2490/15; F01N 2490/155

See application file for complete search history.

(56) References Cited

U.S. PATENT DOCUMENTS 2,166,417 A * 7/1939 Manning ..... F02M 35/1216 181/256
2,618,354 A * 11/1952 Hedrick ..... F01N 1/003 181/266
2,834,425 A * 5/1958 Rawson ..... F01N 13/185 181/252
2,850,111 A 9/1958 Nelson
3,107,748 A * 10/1963 Arthur ..... F01N 13/185 181/245

(Continued)

FOREIGN PATENT DOCUMENTS

FR 3018309 B1 4/2016

*Primary Examiner* — Edgardo San Martin
(74) *Attorney, Agent, or Firm* — Lee & Hayes, PLLC

(57) ABSTRACT

An apparatus for engine exhaust sound attenuation includes a housing, a plurality of baffle plates arranged within the housing. The baffle plates are disposed apart from each other to define a plurality of intermediate chambers. The plurality of intermediate chambers includes a first resonant chamber proximate to the outlet chamber, a second resonant chamber proximate to the inlet chamber, a first intermediate chamber proximate to the second resonant chamber, and a second intermediate chamber proximate to the first intermediate chamber and the first resonant chamber. An inlet tube and an outlet tube are included. A first tube directs a flow of exhaust from the inlet chamber to one of the plurality of intermediate chambers via an interior of the first tube. Additionally, a second tube directs the flow of exhaust from a second one of the plurality of intermediate chambers to the outlet chamber via an interior of the second tube.

20 Claims, 4 Drawing Sheets

(56) References Cited

U.S. PATENT DOCUMENTS 3,181,647 A * 5/1965 Schomburg ..... F01N 1/00 181/266
3,613,829 A * 10/1971 Palmer ..... F01N 1/089 181/269
3,703,938 A * 11/1972 Nelson ..... F01N 13/04 181/274
3,827,531 A * 8/1974 Hansen ..... F01N 13/18 181/265
3,966,016 A * 6/1976 Hecht ..... F01N 3/26 181/269
4,064,963 A * 12/1977 Kaan ..... F01N 13/14 181/244
4,458,779 A 7/1984 Johansson et al.
4,846,228 A * 7/1989 Blanscet ..... F16L 55/0279 138/26
4,846,302 A * 7/1989 Hetherington ..... F01N 1/10 181/243
4,911,262 A 3/1990 Tani et al.
4,961,314 A * 10/1990 Howe ..... F01N 1/02 181/231
5,009,065 A * 4/1991 Howe ..... F01N 1/02 55/314
5,048,287 A * 9/1991 Howe ..... F01N 3/032 60/288
5,183,977 A * 2/1993 Horitani ..... F01N 1/084 181/266
6,241,044 B1 6/2001 Nishiyama et al.
8,356,690 B2 1/2013 Wakatsuki
8,905,188 B2 12/2014 Park
9,534,522 B2 1/2017 Gommans
10,196,947 B2 * 2/2019 LeRoy ..... G10K 11/161
2005/0224283 A1 * 10/2005 Yokoi ..... F01N 1/084 181/268
2012/0273299 A1 11/2012 Jones et al.
2012/0273301 A1 11/2012 Jones et al.
2017/0218806 A1 8/2017 LeRoy

* cited by examiner

MULTI-CHAMBERED SOUND ATTENUATION WITH RESONANT FREQUENCY TARGETING

TECHNICAL FIELD

The present disclosure relates to a sound attenuation system for an internal combustion engine on a machine. More specifically, the present disclosure relates to a multi-chambered sound attenuation system that targets multiple ranges of frequencies.

BACKGROUND

Internal combustion engines generate engine and exhaust noise due to the combustion of fuel, and due to exhaust gas passing through the engine emission system. Some noise-sensitive locations may require the use of noise attenuation components such as mufflers. Most exhaust muffling systems are configured to muffle lower frequency noise (such as, for example 0-300 Hz). Mid to high frequency noise (such as, for example 300-5000 Hz) may also be emitted by an internal combustion exhaust system due to exhaust gasses traversing the exhaust system. Commercially-available muffler systems may not meet performance requirements for low, mid, and high frequency sound attenuation, while also satisfying other non-performance requirements such as, for example, ease of manufacturability, pressure drop targets, overall costing targets etc.

An example system for sound attenuation is described in U.S. Patent Application No. 2017/0218806 (hereinafter referred to as the '806 reference). In particular, the '806 reference describes a muffler system with three chambers for sound attenuation. The system described in the '806 reference does not, however, target both low, mid, and high frequency noises while attenuating sound 28-35 decibels (dB). Moreover, conventional muffler systems, including the system described in the '806 reference, may not attenuate noise to these noise reduction levels while minimizing manufacturing complexity and cost. For example, the '806 reference describes a muffler design that may be unnecessarily complex, with a high number of unique parts that are not repeated throughout the assembly.

Example embodiments of the present disclosure are directed toward overcoming the deficiencies described above.

SUMMARY

In an aspect of the present disclosure, an apparatus for engine exhaust sound attenuation includes a housing having an interior and an exterior, and a plurality of baffle plates arranged within the housing. The plurality of baffle plates may be disposed apart from each other to define an inlet chamber at a proximal end of the housing, an outlet chamber at a distal end of the housing, and a plurality of intermediate chambers disposed between the inlet chamber and the outlet chamber. The plurality of intermediate chambers include a first intermediate chamber proximate to the inlet chamber, a second intermediate chamber proximate to the first intermediate chamber, and a third intermediate chamber proximate to the second intermediate chamber and the outlet chamber. An inlet tube is disposed fluidly connected to the housing and configured to direct a flow of exhaust from the exterior of the housing to the inlet chamber. An outlet tube is disposed fluidly connected to the housing and configured to direct the flow of exhaust from the outlet chamber to the exterior of the housing. A first tube is configured to direct the flow of exhaust from the inlet chamber to one of the plurality of intermediate chambers via an interior of the first tube, and a second tube is configured to direct the flow of exhaust from a second one of the plurality of intermediate chambers to the outlet chamber via an interior of the second tube.

In another aspect of the present disclosure, an apparatus for engine exhaust sound attenuation is described. The apparatus includes a housing having an interior and an exterior, and a plurality of baffle plates arranged within the housing. The baffle plates are disposed apart from each other to define an inlet chamber at a proximal end of the housing, an outlet chamber at a distal end of the housing, and a plurality of intermediate chambers disposed between the inlet chamber and the outlet chamber. The plurality of intermediate chambers includes a first resonant chamber proximate to the outlet chamber, a second resonant chamber proximate to the inlet chamber, a first intermediate chamber proximate to the second resonant chamber, and a second intermediate chamber proximate to the first intermediate chamber and the first resonant chamber. The apparatus further includes an inlet tube disposed fluidly connected to the housing and configured to direct a flow of exhaust from the exterior of the housing to the inlet chamber, an outlet tube disposed fluidly connected to the housing and configured to direct the flow of exhaust from the outlet chamber to the exterior of the housing, a first tube configured to direct the flow of exhaust from the inlet chamber to one of the plurality of intermediate chambers via an interior of the first tube, and a second tube configured to direct the flow of exhaust from a second one of the plurality of intermediate chambers to the outlet chamber via an interior of the second tube.

In yet another aspect of the present disclosure an engine connected with a sound attenuation apparatus is described. The sound attenuation apparatus includes a housing having an interior and an exterior, and a plurality of baffle plates arranged within the housing. The baffle plates are disposed apart from each other to define an inlet chamber at a proximal end of the housing, an outlet chamber at a distal end of the housing, and a plurality of intermediate chambers disposed between the inlet chamber and the outlet chamber. The plurality of intermediate chambers includes a first resonant chamber proximate to the outlet chamber, a second resonant chamber proximate to the inlet chamber, a first intermediate chamber proximate to the second resonant chamber, and a second intermediate chamber proximate to the first intermediate chamber and the first resonant chamber. The apparatus further includes an inlet tube disposed fluidly connected to the housing and configured to direct a flow of exhaust from the exterior of the housing to the inlet chamber, an outlet tube disposed fluidly connected to the housing and configured to direct the flow of exhaust from the outlet chamber to the exterior of the housing, a first tube configured to direct the flow of exhaust from the inlet chamber to one of the plurality of intermediate chambers via an interior of the first tube, and a second tube configured to direct the flow of exhaust from a second one of the plurality of intermediate chambers to the outlet chamber via an interior of the second tube.

DETAILED DESCRIPTION

Figure 1:
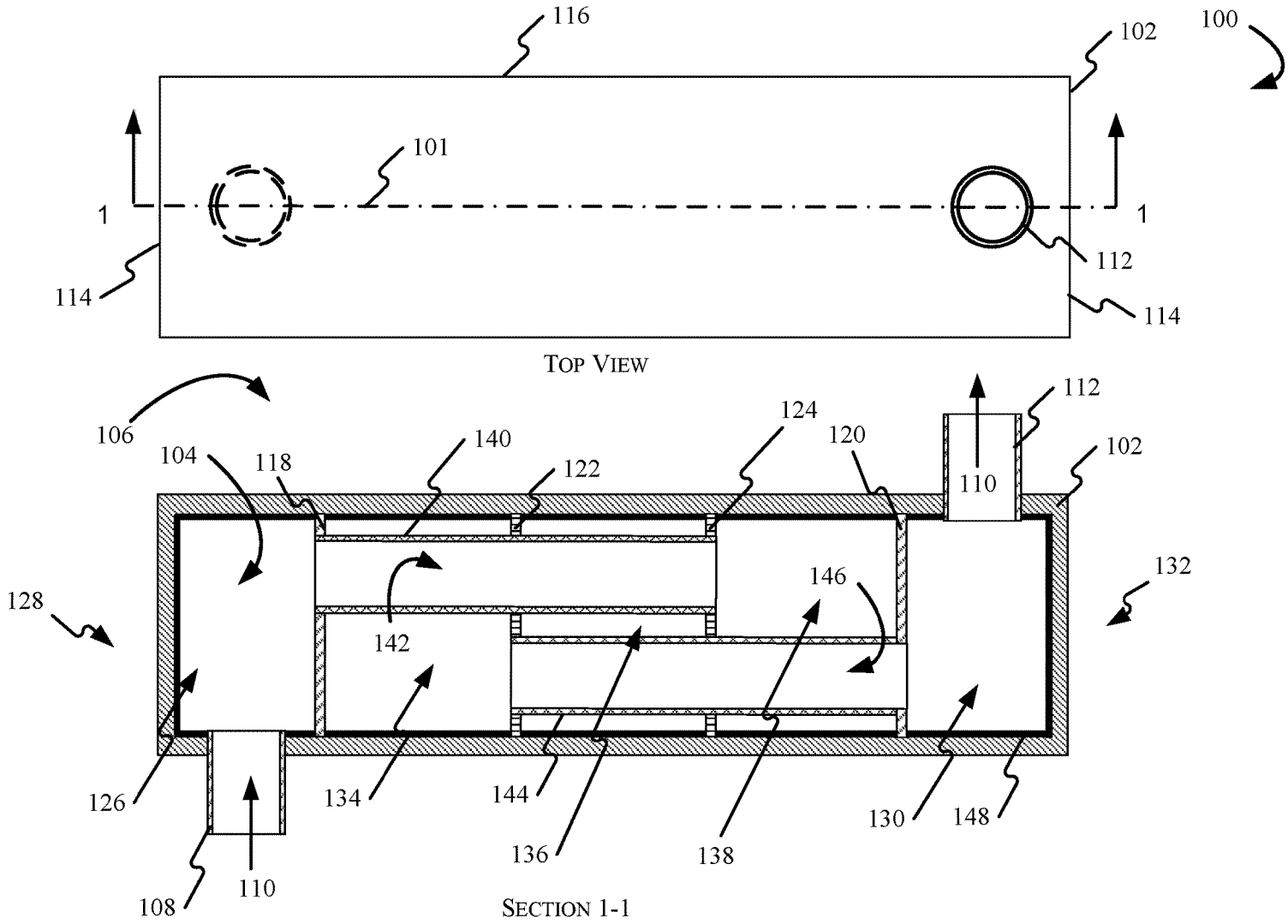
FIG. 1 is a top view and a section view of a sound attenuation apparatus in accordance with an example embodiment of the present disclosure.

FIG. 1 shows a top view and a section view 1-1 of an exemplary sound attenuation apparatus 100 (hereafter "apparatus 100"). The apparatus 100 includes a housing 102 having a housing interior 104 and a housing exterior 106. The apparatus 100 may include an inlet tube 108 disposed fluidly connected to the housing 102 to direct a flow of exhaust from the housing exterior 106 to the housing interior 104. In some examples, at least part of the inlet tube 108 may extend into the housing interior 104. The apparatus 100 further includes an outlet tube 112 disposed fluidly connected to the housing 102 to direct the flow of exhaust 110 from the housing interior 104 to the housing exterior 106. In one embodiment, the inlet tube 108 and the outlet tube 112 are disposed substantially perpendicular to a longitudinal axis 101 of the housing 102. It should be appreciated that the apparatus 100 is connectable to an exhaust port of a combustion motor (not shown) via the inlet tube 108, and may connect with one or more downstream emission components (not shown) via the outlet tube 112. Accordingly, any mechanisms attachable to the apparatus 100 may be considered exterior to the housing 102.

The housing 102 is depicted as generally cylindrical in shape having two end wall(s) 114 and a cylindrical side wall 116. The end wall(s) 114 and the cylindrical side wall 116 may be formed of one or more pieces, although they may include several separate pieces welded or otherwise joined together. It should be appreciated that the apparatus 100, although depicted as generally cylindrical, may take other general shapes including an elliptical cylinder, rectangle, etc. The housing 102 may be fabricated of heavy gauge, rust and heat-resistant material such as, for example, sheet metal. For example, the housing 102 may be generally constructed from stainless steel, or another heat and corrosion resistant metallic alloy, heat-resistant carbon fiber, or another suitable material. Under certain sets of circumstances, it is contemplated that the end wall(s) 114 may be removed from, for example, the cylindrical side wall 116 by breaking one or more weldments connecting the end wall(s) 114 and the cylindrical side wall 116. With the end wall(s) 114 removed, various parts or components disposed within the housing interior 104 may be inspected and/or serviced.

The apparatus 100 includes a plurality of baffle plates arranged within the housing interior 104. The plurality of baffle plates can include a first set of identical baffle plates 118 and 120, and a second set of identical baffle plates 122 and 124. The plurality of baffle plates 118-124 may be arranged within the housing interior 104, disposed apart from each other to define an inlet chamber 126 at a proximal end 128 of the apparatus 100, an outlet chamber 130 disposed at a distal end 132 of the apparatus 100, a first intermediate chamber 134 proximate to the inlet chamber 126, a second intermediate chamber 136 proximate to the first intermediate chamber 134, and a third intermediate chamber 138 proximate to the second intermediate chamber 136 and the outlet chamber 130.

In one embodiment, the first set of identical baffle plates includes the baffle plate 118 and the baffle plate 120. The baffle plates 118 and 120 may be configured to be identical to one another with similar dimensions and features such that a single pattern may be used to manufacture both of the baffle plates 118 and 120. This feature may provide ease of manufacturability by reducing design complexity and manufacturing cost. The first set of identical baffle plates 118, 120 may be unperforated to fluidly isolate the inlet chamber 126 from the first intermediate chamber 134, and fluidly isolate the outlet chamber 130 and the third intermediate chamber 138.

In another aspect, the plurality of baffle plates further comprises the baffle plate 122 and the baffle plate 124. The baffle plates 122 and 124 may be referred to, collectively, as the second set of identical baffle plates. The baffle plates 122 and 124 may be configured to provide partial fluid separation between the plurality of intermediate chambers (134, 136, and 138). For example, the baffle plate 122 may be disposed in the housing interior 104 to provide partial fluid separation of the second intermediate chamber 136 and the first intermediate chamber 134. As used herein, partial fluid separation means that fluid, such as the flow of exhaust 110, can freely pass from one chamber to another chamber with minimal impedance from the baffle plate. The impedance may be due to, for example, a perforation pattern having a predetermined ratio of open surface area (e.g., a hole or other opening) to closed surface area (the face of the baffle plate in which the hole or other opening is made). According to one or more embodiments, the predetermined ratio of open surface area to closed surface can be limited to a range of area values that may be observed to target sound attenuation at higher frequencies. For example, although the five-chamber configuration as depicted in FIG. 1 can attenuate sound at approximately 30 dB or more across lower frequencies (e.g., 0-300 Hz), in some aspects mid-range and high frequencies (e.g., 300-5000 Hz) may be attenuated at approximately 30 dB or more when the perforation pattern of the second set of baffles is at least approximately 28% open area to closed area, and less than or equal to approximately 32% open area to closed area. In other embodiments, values greater or less than those noted above are contemplated.

The apparatus 100 further includes a first tube 140 that may be fluidly connected to the inlet chamber 126, and configured to direct the flow of exhaust 110 from the inlet chamber 126 to one of the plurality of intermediate chambers 134, 136, and/or 138 via an interior 142 of the first tube 140. In the embodiment depicted in FIG. 1, the first tube 140 may direct the flow of exhaust 110 from the inlet chamber 126 to the third intermediate chamber 138 via the interior 142 of the first tube 140.

In another aspect, the apparatus 100 also includes a second tube 144 configured to direct the flow of exhaust 110 from a second one of the plurality of intermediate chambers 134, 136, and/or 138 to the outlet chamber 130 via an interior 146 of the second tube 144. In the embodiment depicted in FIG. 1, the second tube 144 facilitates the flow of exhaust 110 from the first intermediate chamber 134 to the outlet chamber 130 via the interior 146 of the second tube 144.

According to embodiments of the present disclosure, the apparatus 100 may incorporate multiple copies of the same part (that is, multiple parts may be identical in that they share the same features and dimensions). For example, the first tube 140 may include features and dimensions that may be the same as corresponding features and dimensions of the second tube 144, such that multiple copies of the one part can (e.g., the first tube 140) may be copied to stand in the place of another part (e.g., the second tube 144). Accordingly, the copied part may be oriented differently from the first part to produce the described sound attenuation without added complexity of multiple designs for custom parts. Two substantially identical parts may share the same feature. One example of such a feature is a perforation pattern having a predetermined ratio of open surface area to closed surface area. Another example of such a feature is a hole in a baffle plate shaped, sized, positioned, and/or otherwise configured to mate with and/or accept the first tube 140 and/or the second tube 144. In a similar respect, the first pair of baffle plates 118 and 120 may be identical parts, where a hole is made in both parts at the same location to accept the inside or outside diameters of the first tube 140 and the second tube 144. Accordingly, the baffle plates 118 and 120 may include identical features.

In another aspect, two parts may share the same dimensions. An example of such a dimension is a diameter measurement for a circular baffle plate (e.g., the baffle plates 118-120). In another example, a shared dimension between identical parts may include a diameter of a hole in the baffle plate 118 that accommodates the first tube 140, such that the first tube 140 may be welded to the baffle plate 118. In another aspect, the first tube 140 may include a same inner diameter as the second tube, a same outer diameter as the second tube 144, and/or a same length as the second tube 144. In the embodiment of FIG. 1, a second copy of the baffle plate 118 (the baffle plate 120) may include the same dimensions such as, for example, a same thickness, a same shape, a same inside diameter of corresponding through holes, a same outside diameter (when the housing is cylindrical), etc. Accordingly, the baffle plate 120 may be identical to the baffle plate 118, but oriented by axially rotating 180 degrees about an axis 101 such that the hole for the second tube 144 is axially aligned with the position of the second tube 144. In another aspect, an example dimension may be a diameter of the hole in the baffle plates 118 and 120 to accommodate the first tube 140 and second tube 144, respectively.

In yet another aspect, parts may be identical (by sharing the same dimensions and features) because they share the same predetermined perforation pattern, shape, length, diameter, etc., such that one of the identical parts may be substituted for another part in the apparatus 100. For example, the first tube 140 may be substituted for the second tube 144, and vice versa. In another example, the first baffle plate 118 may be substituted for the baffle plate 120, and vice versa. As another example, the baffle plate 122 may be substantially identical to the baffle plate 124, such that any one of the baffle plates 122 and 124 may be substituted for the other by orienting at 180 degrees of axial rotation with respect to the other part. It should be appreciated that simplicity in design may be an attribute that may provide many benefits to embodiments of the present disclosure, such as manufacturing efficiencies, as well as reduced inventory for repair and replacement parts.

The apparatus 100 may further include a sound insulating layer 148 disposed on an interior surface of the housing interior 104, wherein the sound insulating layer 148 may be proximate to the flow of exhaust 110. The sound insulating layer 148 may provide a thermal and/or acoustic barrier that impedes sound transfer and heat transfer from the housing interior 104 to the housing exterior 106. In any of the examples described herein, the sound insulating layer 148 may be formed from one or more thermal insulation materials and/or acoustic insulation materials such as a mineral fiber, rockwool, etc. In one aspect, the sound insulating layer 148 may be disposed on an inside surface of the housing interior 104 such that the insulating material can be in direct contact with and/or proximate to the flow of exhaust 110.

Figure 2:
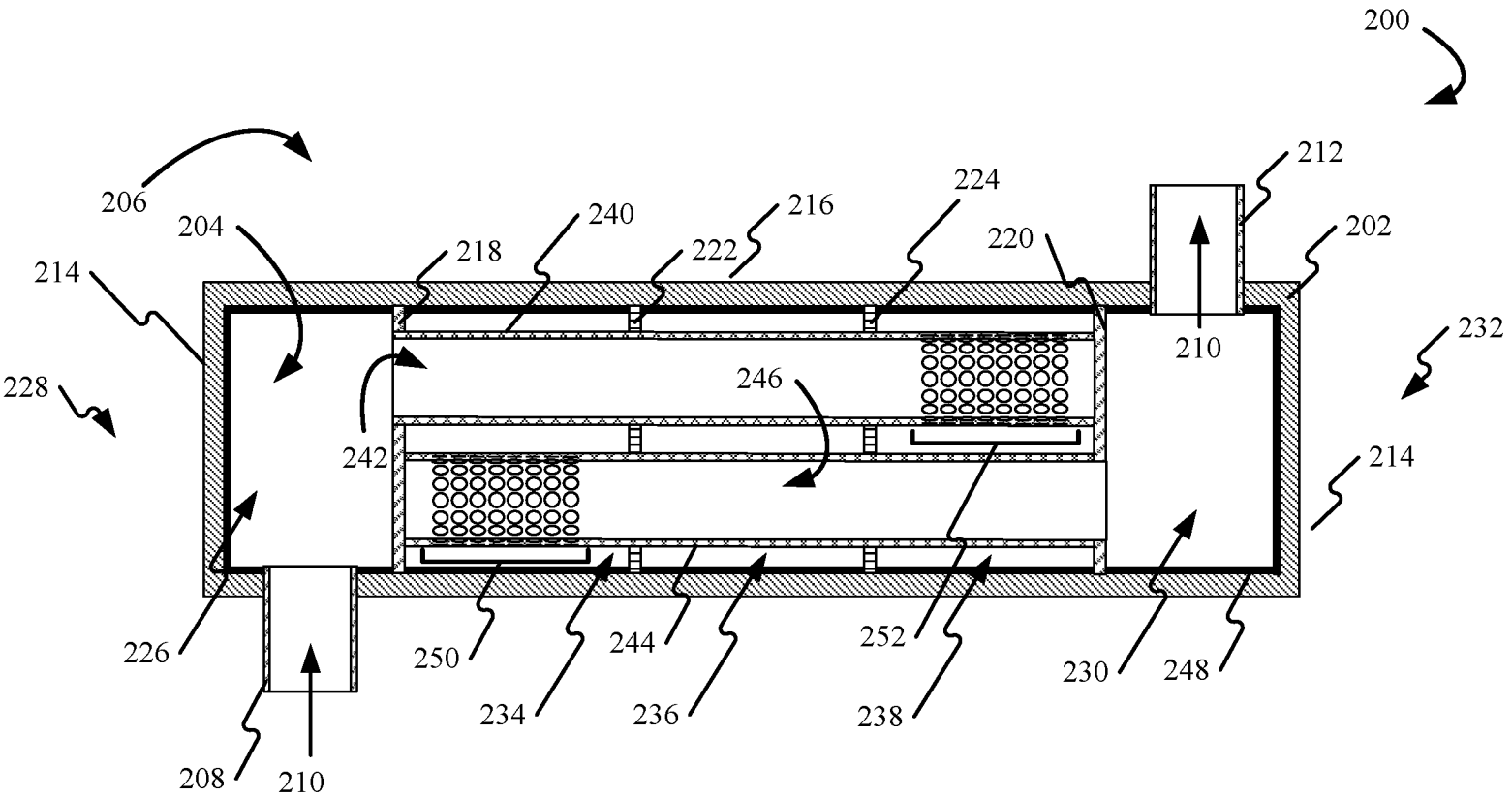
FIG. 2 is a section view of a sound attenuation apparatus in accordance with another example embodiment of the present disclosure.

FIG. 2 depicts a section view of an exemplary sound attenuation apparatus 200 (hereafter "apparatus 200"). In FIG. 2 (as well as in FIGS. 3 and 4), the top view is omitted for simplicity. The apparatus 200 may be substantially similar to the apparatus 100 depicted with respect to FIG. 1, but with a perforated section 250 and a perforated section 252, as shown in FIG. 2. For example, the apparatus 200 can include a housing 202 having a housing interior 204 and a housing exterior 206. The apparatus 200 may also include an inlet tube 208 disposed fluidly connected to the housing 202 to direct a flow of exhaust 210 from the housing exterior 206 to the housing interior 204. The inlet tube 208 and the outlet tube 212 may be disposed substantially perpendicular to a longitudinal axis (not shown in FIG. 2) of the housing 202. The apparatus 200 can further include an outlet tube 212 disposed fluidly connected to the housing 202 to direct the flow of exhaust 210 from the housing interior 204 to the housing exterior 206. In some examples, at least part of the inlet tube 208 and/or the outlet tube 212 may extend into the housing interior 204. It should be appreciated that, like the sound attenuation apparatus 100, the sound attenuation apparatus 200 may be connectable to an exhaust port of a combustion motor (not shown) via the inlet tube 208, and may connect with one or more downstream emission components (not shown) via the outlet tube 212. Accordingly, any mechanisms attachable to the apparatus 200 may be considered exterior to the housing 202.

The housing 202 may be substantially similar to and/or identical to the housing 102 as depicted in FIG. 1. For example, the housing 202 is shown as generally cylindrical in shape having two end wall(s) 214 and a cylindrical side wall 216. The end wall(s) 214 and the cylindrical side wall 216 may be formed of one or more pieces, although they may be several separate pieces welded or otherwise joined together. It should be appreciated that the apparatus 200, although depicted as generally cylindrical, may take other general shapes including an elliptical cylinder, rectangular, etc.

The apparatus 200 can include a plurality of baffle plates 218, 220, 222, and 224, that may be arranged within the housing interior 204. The plurality of baffle plates 218-224 may be substantially similar and/or identical to the plurality of baffle plates 118-124, depicted with respect to FIG. 1. For example, the plurality of baffle plates, as shown in FIG. 2, can include a first set of identical baffle plates 218 and 220, and a second set of identical baffle plates 222 and 224. The plurality of baffle plates 218-224 may be arranged within the housing interior 204, disposed apart from each other to define an inlet chamber 226 at a proximal end 228 of the apparatus 200, an outlet chamber 230 disposed at a distal end 232 of the apparatus 200, a first intermediate chamber 234 proximate to the inlet chamber 226, a second intermediate chamber 236 proximate to the first intermediate chamber 234, and a third intermediate chamber 238 proximate to the second intermediate chamber 236 and the outlet chamber 230.

In one embodiment, the first set of identical baffle plates can include the baffle plate 218 and the baffle plate 220. The baffle plates 218 and 220 may be configured to be identical to one another with similar dimensions and features such that a single pattern may be used to manufacture both of the baffle plates 218 and 220. This feature may provide ease of manufacturability by reducing design complexity and manufacturing cost. The first set of identical baffle plates 218 and 220 may be unperforated to fluidly isolate the inlet chamber 226 from the first intermediate chamber 234, and fluidly isolate the outlet chamber 230 from the third intermediate chamber 238.

In another aspect, the plurality of baffle plates further comprises a baffle plate 222 and a baffle plate 224. The baffle plates 222 and 224 may be referred to, collectively, as a second set of identical baffle plates. The baffle plates 222 and 224 may be configured to provide partial fluid separation between the plurality of intermediate chambers. For example, the baffle plate 222 may be disposed in the housing interior 204 to provide partial fluid separation of the second intermediate chamber 236 and the first intermediate chamber 234. As used herein, partial fluid separation means that fluid such as the flow of exhaust 210 can freely pass from one chamber to another chamber with minimal impedance from the baffle plate. The impedance may be due to, for example, a perforation pattern having a predetermined ratio of open surface area (e.g., a hole or other opening) to closed surface area (the face of the baffle plate in which the hole or other opening is made). According to one or more embodiments, the predetermined ratio of open surface area to closed surface can be limited to a range of area values that may be observed to target sound attenuation at higher frequencies. For example, although the five-chamber configuration as depicted in FIG. 2 can attenuate sound at approximately 30 dB or more across lower frequencies (e.g., approximately 0-300 Hz), in some aspects, mid-range and high frequencies (e.g., approximately 300-5000 Hz) may be attenuated approximately 30 dB or more when the perforation pattern of the second set of baffles may be at least 28% open area to closed area, and less than or equal to approximately 32% open area to closed area. In some aspects, the predetermined pattern may be a grid or array of round holes, or another shape repeated such that the ratio of open area to closed area described above may be met. In other embodiments, values greater or less than those noted above are contemplated.

The apparatus 200 may further include a first tube 240 configured to direct the flow of exhaust 210 from the inlet chamber 226 to one of the plurality of intermediate chambers 234, 236, and/or 238 via an interior 242 of the first tube 240. In the embodiment depicted in FIG. 2, the first tube 240 can facilitate the flow of exhaust 210 from the inlet chamber 226 to the third intermediate chamber 238 via the interior 242 of the first tube 240. The first tube 240 may extend from and fluidly connect the inlet chamber 226 to the third intermediate chamber 238. In one aspect, the first tube 240 can terminate at a surface of the baffle plate 220. The end of the first tube 240 in contact with the baffle plate 220 may be fluidly sealed with the baffle plate 220 at the end of the tube by welding or another method. A perforated section 252 of the first tube 240 in the third intermediate chamber 238 may incorporate the perforation pattern having the predetermined ratio of open surface area to closed surface area (described previously with respect to FIG. 1). In some aspects, the perforated section 252 may extend around a periphery of the first tube 240 to fluidly connect the interior 242 of the first tube 240 to the third intermediate chamber 238.

In another aspect, the apparatus 200 also includes a second tube 244 configured to direct the flow of exhaust 210 from a second one of the plurality of intermediate chambers 234, 236, and/or 238 to the outlet chamber 230 via an interior 246 of the second tube 244. In the embodiment depicted in FIG. 2, the second tube 244 may facilitate the flow of exhaust 210 from the first intermediate chamber 234 to the outlet chamber 230 via the interior 246 of the second tube 244. The second tube 244 may extend from and fluidly connect the outlet chamber 230 to the first intermediate chamber 234. In one aspect, the second tube 244 may terminate at a surface of the baffle plate 218. The end of the second tube 244 in contact with the baffle plate 218 may be fluidly sealed with the baffle plate 218 at the end of the tube by welding or another method. A portion of the second tube 244 in the first intermediate chamber 234 can include a perforated section 250 having a perforation pattern with the predetermined ratio of open surface area to closed surface area (described previously with respect to the first tube 240). In some aspects, the perforated section 250 may extend around a periphery of the second tube 244 to fluidly connect the interior 246 of the second tube 244 to the first intermediate chamber 234.

According to embodiments of the present disclosure, and similar to the embodiment described with respect to FIG. 1, the apparatus 200 may incorporate multiple copies of the same part (that is, multiple parts may be identical in that they share the same features and dimensions). For example, the first tube 240 may include features and dimensions that may be the same as corresponding features and dimensions of the second tube 244, such that multiple copies of the one part can (e.g., the first tube 240) may be copied in another part (e.g., the second tube 244), and the copied part may be oriented differently from the first part to produce the described sound attenuation without added complexity of multiple designs for custom parts. In one aspect, the inlet tube 208 may be substantially identical to the outlet tube 212 such that the inlet tube 208 may be shaped, sized, positioned, and/or otherwise configured to mate with and/or accept contiguous parts such that it can be substituted for the outlet tube 212, and vice versa. In another aspect, the first tube 240 may include a same inner diameter as the second tube 244, a same outer diameter as the second tube 244, and/or a same length as the second tube 244. In yet another aspect, the first tube 240 may be substantially identical to the second tube 244 such that one may be substituted for the other, and vice versa. In another aspect, the baffle plate 218 may be substantially identical to the baffle plate 220 such that the baffle plate 218 may be substituted for the baffle plate 220, and vice versa. In one aspect, the inlet tube 208 may be substantially identical to the outlet tube 212 such that the inlet tube 208 may be substituted for the outlet tube 212, and vice versa. In another aspect, the baffle plate 222 may be substantially identical to the baffle plate 224 such that one may be substituted for the other, and vice versa.

The apparatus 200 may further include a sound insulating layer 248 disposed on an interior surface of the housing interior 204, wherein the sound insulating layer 248 is proximate to the flow of exhaust 210. The sound insulating layer 248 may be substantially similar and/or identical to the sound insulating layer 148, in that it may provide a thermal and/or acoustic barrier that impedes sound transfer and heat transfer from the housing interior 204 to the housing exterior 206. In one aspect, the sound insulating layer 248 may be disposed on an inside surface of the housing interior 204 such that the sound insulating layer 248 may be in direct contact with and/or proximate to the flow of exhaust 210.

Figure 3:
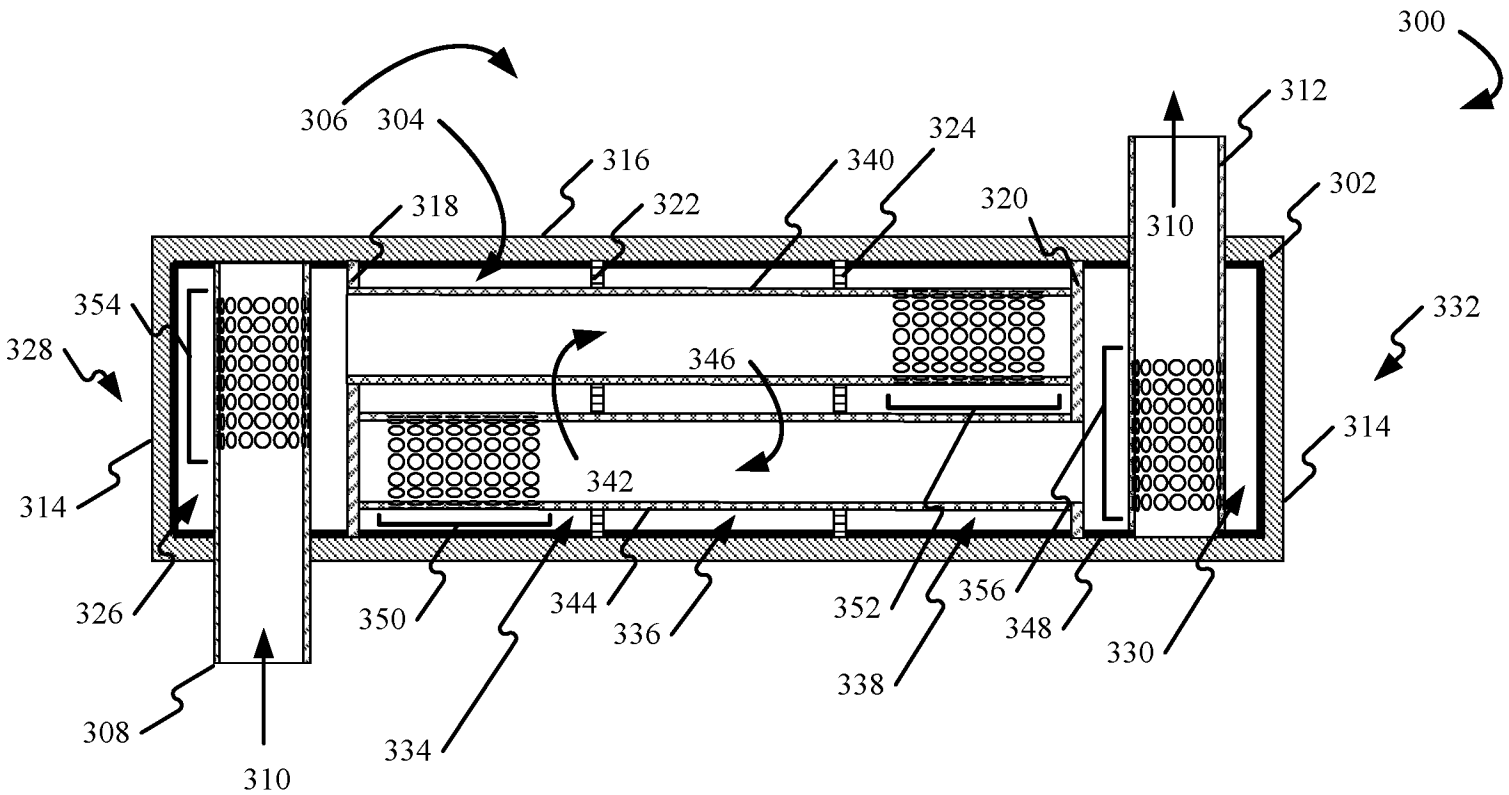
FIG. 3 is a section view of a sound attenuation apparatus in accordance with another example embodiment of the present disclosure.

FIG. 3 depicts a section view of an exemplary sound attenuation apparatus 300 (hereafter "apparatus 300"). The apparatus 300 may be substantially similar to the apparatus 2 depicted with respect to FIG. 2, with perforated sections (354, 356) added to the inlet tube 308, and the outlet tube 312, respectively. For example, the apparatus 300 can include a housing 302 having a housing interior 304 and a housing exterior 306. The apparatus 300 may include an inlet tube 308 disposed fluidly connected to the housing 302 to direct a flow of exhaust 310 from the housing exterior 306 to the housing interior 304. In some examples, at least part of the inlet tube 308 may extend into the housing interior 304. The apparatus 300 can further include an outlet tube 312 disposed through the housing 302 to direct the flow of exhaust 310 from the housing interior 304 to the housing exterior 306. In some examples, at least part of the outlet tube 312 may extend into the housing interior 304. The inlet tube 308 and the outlet tube 312 may be disposed substantially perpendicular to a longitudinal axis (not shown in FIG. 3) of the housing 302. It should be appreciated that, like the sound attenuation apparatuses 100 and 200, the sound attenuation apparatus 300 may be connectable to an exhaust port of a combustion motor (not shown) via the inlet tube 308, and may connect with one or more downstream emission components (not shown) via the outlet tube 312. Accordingly, any mechanisms attachable to the apparatus 200 may be considered exterior to the housing 302.

In one aspect, the inlet tube 308 may terminate at a surface of the housing interior 304. The end of the inlet tube 308 that touches the housing interior 304 may be fluidly sealed by welding or by another means for mechanically coupling the open end of the inlet tube 308 to the housing interior 304. In another aspect, a portion of the inlet tube 308 in the inlet chamber 326 comprises the perforated section 354 having the predetermined ratio of open surface area to closed surface area as described above with respect to FIGS. 1 and 2. In one aspect, the perforated section 354 may extend around a periphery of the inlet tube 308 to fluidly connect an interior of the inlet tube 308 to the inlet chamber 326.

In another aspect, outlet tube 312 may terminate at a surface of the housing interior 304 in an outlet chamber 330. The end of the outlet tube 312 that touches the housing interior 304 may be fluidly sealed by welding or by another means for mechanically coupling the open end of the outlet tube 312 to the housing interior 304. In another aspect, a portion of the outlet tube 312 in the outlet chamber 330 comprises the perforated section 356 having the predetermined ratio of open surface area to closed surface area as described above with respect to FIG. 1 and FIG. 2. In one aspect, the perforated section 356 may extend around a periphery of the outlet tube 312 to fluidly connect an interior of the outlet tube 312 to the outlet chamber 330.

The housing 302 may be substantially similar to and/or identical to the housing 102 as depicted in FIG. 1, and/or the housing 202 as depicted in FIG. 2. For example, the housing 302 is shown as generally cylindrical in shape having two end wall(s) 314 and a cylindrical side wall 316. The end wall(s) 314 and the cylindrical side wall 316 may be formed of one or more pieces, although they may be several separate pieces welded or otherwise joined together. It should be appreciated that the apparatus 300, although depicted as generally cylindrical, may take other general shapes including an elliptical cylinder, rectangle, etc.

The apparatus 300 can include a plurality of baffle plates arranged within the housing interior 304. The plurality of baffle plates (318, 320, 322, and 324), may be substantially similar and/or identical to the baffle plates depicted with respect to FIGS. 1 and 2. For example, the plurality of baffle plates as shown in FIG. 3 can include a first set of identical baffle plates 318 and 320, and a second set of identical baffle plates 322 and 324. The plurality of baffle plates 318-324 may be arranged within the housing interior 304, disposed apart from each other to define an inlet chamber 326 at a proximal end 328 of the apparatus 300, the outlet chamber 330 disposed at a distal end 332 of the apparatus 300, a first intermediate chamber 334 proximate to the inlet chamber 326, a second intermediate chamber 336 proximate to the first intermediate chamber 334, and a third intermediate chamber 338 proximate to the second intermediate chamber 336 and the outlet chamber 330.

In one embodiment, the first set of identical baffle plates can include the baffle plate 318 and the baffle plate 320. The baffle plates 318 and 320 may be configured to be identical to one another with similar dimensions and features such that a single pattern may be used to manufacture both of the baffle plates 318 and 320. This feature may provide ease of manufacturability by reducing design complexity and manufacturing cost. The first set of identical baffle plates 318, 320 may be unperforated to fluidly isolate the inlet chamber 326 from the first intermediate chamber 334, and fluidly isolate the outlet chamber 330 from the third intermediate chamber 338.

In another aspect, the plurality of baffle plates further comprises a baffle plate 322 and a baffle plate 324. The baffle plates 322 and 324 may be referred to, collectively, as a second set of identical baffle plates. The baffle plates 322 and 324 may be configured to provide partial fluid separation between the plurality of intermediate chambers. For example, the baffle plate 322 may be disposed in the housing interior 304 to provide partial fluid separation of the second intermediate chamber 336 and the first intermediate chamber 334. As used herein, partial fluid separation means that fluid such as the flow of exhaust 310 can freely pass from one chamber to another chamber with minimal impedance from a respective baffle plate having partial fluid separation. The impedance may be due to, for example, a perforation pattern having a predetermined ratio of open surface area (e.g., a hole or other opening) to closed surface area (the face of the baffle plate in which the hole or other opening is made). According to one or more embodiments, the predetermined ratio of open surface area to closed surface can be limited to a range of area values that may be observed to target sound attenuation at higher frequencies. For example, although the five-chamber configuration as depicted in FIG. 3 can attenuate sound at approximately 30 dB or more across lower frequencies (e.g., 0-300 Hz), in some aspects mid-range and high frequencies (e.g., 300-5000 Hz) may be attenuated approximately 30 dB or more when the perforation pattern of the second set of baffles may be at least approximately 28% open area to closed area, and less than or equal to approximately 32% open area to closed area. In other embodiments, values greater or less than those noted above are contemplated.

The apparatus 300 may further include a first tube 340 configured to direct the flow of exhaust 310 from the inlet chamber 326 to one of the plurality of intermediate chambers 334, 336, and/or 338 via an interior 342 of the first tube 340. In the embodiment depicted in FIG. 3, the first tube 340 facilitates the flow of exhaust 310 from the inlet chamber 326 to the third intermediate chamber 338 via the interior 342 of the first tube 340. The first tube 340 may extend from and fluidly connects the inlet chamber 326 to the third intermediate chamber 338. In one aspect, the first tube 340 can terminate at a surface of the baffle plate 320. The end of the first tube 340 in contact with the baffle plate 320 may be fluidly sealed with the baffle plate 320 at the end of the tube by welding or another method. A portion of the first tube in the third intermediate chamber 338 may incorporate the perforated section 352 having a perforation pattern with the predetermined ratio of open surface area to closed surface area (described previously with respect to FIGS. 1 and 2). In some aspects, the perforated section 352 may extend around a periphery of the first tube 340 to fluidly connect the interior 342 of the first tube 340 to the third intermediate chamber 338.

In another aspect, the apparatus 300 also includes a second tube 344 configured to direct the flow of exhaust 310 from a second one of the plurality of intermediate chambers 334, 336, and/or 338 to the outlet chamber 330 via an interior 346 of the second tube 344. In the embodiment depicted in FIG. 3, the second tube 344 may facilitate the flow of exhaust 310 from the first intermediate chamber 334 to the outlet chamber 330 via the interior 346 of the second tube 344. The second tube 344 may extend from and fluidly connect the outlet chamber 330 to the first intermediate chamber 334. In one aspect, the second tube 344 may terminate at a surface of the baffle plate 318. The end of the second tube 344 in contact with the baffle plate 318 may be fluidly sealed with the baffle plate 318 at the end of the tube by welding or another method. A portion of the second tube 344 in the first intermediate chamber 334 can include the perforated section 350 having the perforation pattern with the predetermined ratio of open surface area to closed surface area (described previously with respect to FIGS. 1 and 2). In some aspects, the perforated section 350 may extend around a periphery of the second tube 344 to fluidly connect the interior 346 of the second tube 344 to the first intermediate chamber 334.

According to embodiments of the present disclosure, and similar to the embodiment described with respect to FIGS. 1 and 2, the apparatus 300 may incorporate multiple copies of the same part (that is, multiple parts may be identical in that they share the same features and dimensions). For example, the first tube 340 comprises features and dimensions that may be the same as corresponding features and dimensions of the second tube 344, such that multiple copies of the one part can (e.g., the first tube 340) may be copied in another part (e.g., the second tube 344), and the copied part may be oriented different from the first part to produce the described sound attenuation without added complexity of multiple designs for custom parts. In one aspect, the inlet tube 308 may be substantially identical to the outlet tube 312 such that the inlet tube 308 may be shaped, sized, positioned, and/or otherwise configured to mate with and/or accept contiguous parts such that it can substituted for the outlet tube 312, and vice versa. In one aspect, the inlet tube 308 may be substantially identical to the outlet tube 312 such that the inlet tube 308 may be substituted for the outlet tube 312, and vice versa. In another aspect, the first tube 340 may include a same inner diameter as the second tube 344, a same outer diameter as the second tube 344, a same perforated section 352 as the second tube 344, and/or a same length as the second tube 344. In another aspect, the baffle plate 318 may be substantially identical to the baffle plate 320 such that the baffle plate 318 may be substituted for the baffle plate 320, and vice versa. In another aspect, the baffle plate 322 may be substantially identical to the baffle plate 324 such that one may be substituted for the other, and vice versa. In yet another aspect, the first tube 340 may be substantially identical to the second tube 344 such that one may be substituted for the other, and vice versa.

The apparatus 300 may further include a sound insulating layer 348 disposed on an interior surface of the housing interior 304, wherein the sound insulating layer may be proximate to the flow of exhaust. The sound insulating layer 348 may be substantially similar and/or identical to the sound insulating layer 248 and/or 148. In one aspect, the sound insulating layer 348 may be configured on an inside surface of the housing interior 304 such that the sound insulating layer 348 may be in direct contact and/or proximate to the flow of exhaust 310.

Figure 4:
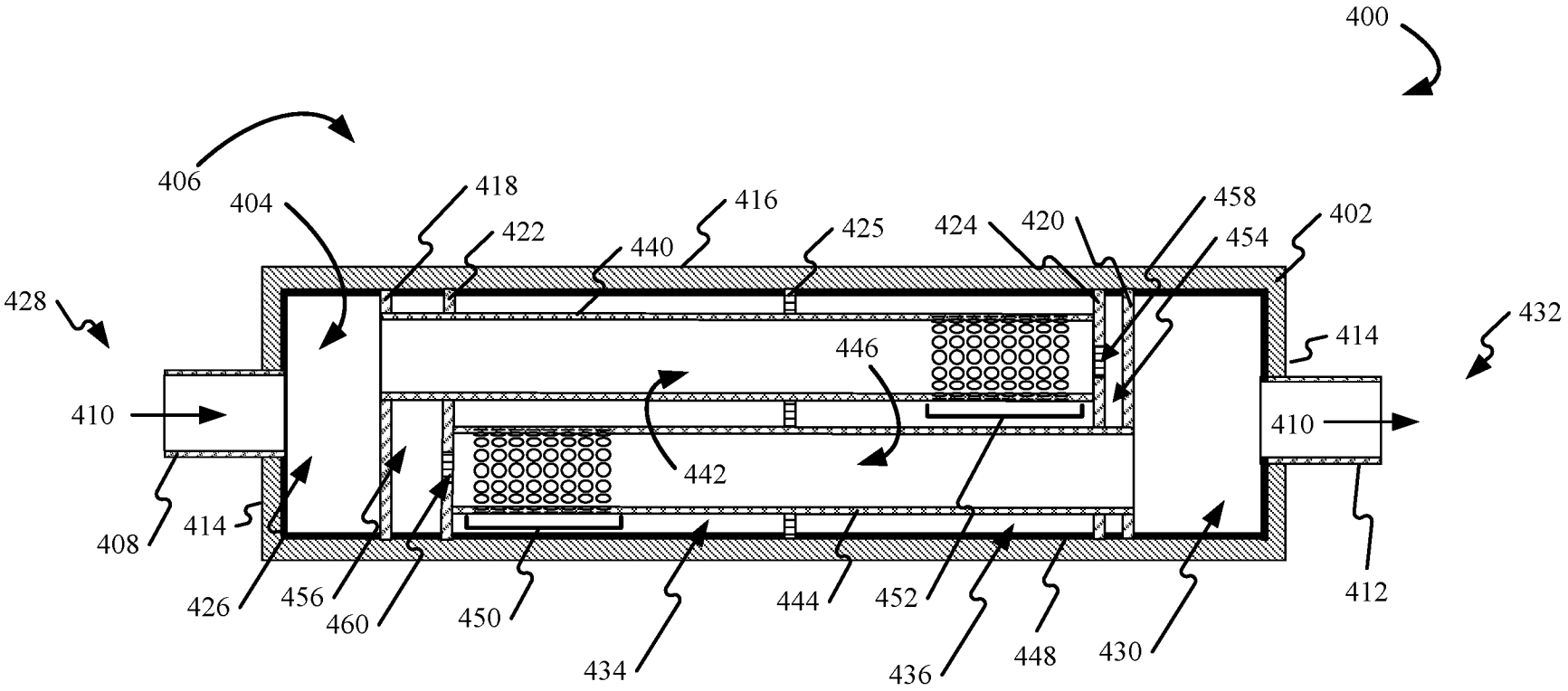
FIG. 4 is a section view of a sound attenuation apparatus in accordance with another example embodiment of the present disclosure.

FIG. 4 depicts a section view of an exemplary sound attenuation apparatus 400 (hereafter "apparatus 400"). The apparatus 400 includes a housing 402 having a housing interior 404 and a housing exterior 406. The apparatus 400 may include an inlet tube 408 disposed fluidly connected to the housing 402 to direct a flow of exhaust 410 from the housing exterior 406 to the housing interior 404. In some examples, at least part of the inlet tube 408 may extend into the housing interior 404. The apparatus 400 may further include an outlet tube 412 disposed connected to an end wall(s) 414 of the housing 402 to direct the flow of exhaust 410 from the housing interior 404 to the housing exterior 406. In some examples, at least part of the outlet tube 412 may extend into the housing interior 404. It should be appreciated that, like the sound attenuation apparatuses 100, 200, and 300, the sound attenuation apparatus 400 may be connectable to an exhaust port of a combustion motor (not shown) via the inlet tube 408, and may connect with one or more downstream emission components (not shown) via the outlet tube 412. Accordingly, any mechanisms attachable to the apparatus 400 may be considered exterior to the housing 402.

In one aspect, the inlet tube 408 and the outlet tube 412 may be disposed axially aligned with a longitudinal axis (not shown in FIG. 4) of the housing 402. In one aspect, a reduced number of sharp turns in the flow of exhaust 410 (with respect to the embodiments of FIGS. 1-3) may reduce high frequency noise content associated with gas flowing through the apparatus 400. For example, it has been observed that mid to high-frequency noise content in exhaust systems may be due to the flow of exhaust (e.g., 410) circulating through various interior components such as the tubes, baffles, etc. When exhaust gas is directed within an interior of the apparatus (e.g., the housing interior 404), in a fashion that results in one or more sharp turns in the flow direction (for example, a change in flow direction approximately 90 degrees or more), any abrupt change in flow direction may result in (and/or add to) high frequency noise content. Accordingly, as shown in FIG. 4, the inlet tube 408 and the outlet tube 412 may be configured to be axially-aligned (e.g., substantially parallel to) an axis of the housing 402. By aligning flow direction to remove some of the abrupt changes in flow direction, embodiments may further attenuate mid and high frequency exhaust noise.

The housing 402 may be substantially similar to and/or identical to the housing 102, 202, and/or 302, as respectively depicted in FIGS. 1, 2, and 3. For example, the housing 402 is shown as generally cylindrical in shape having two end wall(s) 414 and a cylindrical side wall 416. The end wall(s) 414 and the cylindrical side wall 416 may be formed of one or more pieces, although they may be several separate pieces welded or otherwise joined together. It should be appreciated that the apparatus 400, although depicted as generally cylindrical, may take other general shapes including an elliptical cylinder, rectangle, etc.

The apparatus 400 can include a plurality of baffle plates arranged within the housing interior 404. The plurality of baffle plates as shown in FIG. 4 can include a first set of identical baffle plates 418 and 420, and a second set of identical baffle plates 422 and 424, and a center baffle plate 425. The plurality of baffle plates 418-425 may be arranged within the housing interior 404, disposed apart from each other to define an inlet chamber 426 at a proximal end 428 of the apparatus 400, an outlet chamber 430 disposed at a distal end 432 of the apparatus 400, a first resonant chamber 454 proximate to the outlet chamber 430, a second resonant chamber 456 proximate to the inlet chamber 426, a first intermediate chamber 434 proximate to the second resonant chamber 456, and a second intermediate chamber 436 proximate to the first resonant chamber 454 and the first intermediate chamber 434.

In some aspects, it may be desirable to attenuate overall sound approximately 25-33 dB with the sound attenuation apparatuses as describe with respect to FIGS. 1, 2, and 3. In other aspects, it may be desirable to target specific frequencies of noise content that may result from engine exhaust working through exhaust system components such as the sound attenuation apparatus 400. By removing sharp turns in the flow of exhaust 410 (such as, for example, the sharp turns of the flow of exhaust 310 that is directed through ninety-degree turns at the inlet tube 308 and the outlet tubes 312, as depicted in FIG. 3), higher frequency noises may be avoided in situations where high frequency noise content may not be tolerable.

In other aspects, the relative sizes of chambers within the apparatus 400, as well as their configuration as the resonant chambers 454 and 456, or the intermediate chambers 434 and 436 may also attenuate particular (targeted) frequencies of noise content. For example, the resonant chambers 454 and 456 may target specific frequencies of noise content based on relative size of the chamber with respect to other chamber sizes. In one aspect, the first resonant chamber 454, being the smallest chamber of the apparatus 400, may be configured to target approximately 200 Hz to 500 Hz exhaust noise. In other aspects, the second resonant chamber 456 may be configured to attenuate mid-range frequencies (approximately 100 Hz-200 Hz) exhaust noise.

In one embodiment, the plurality of baffle plates may include the baffle plate 418 and the baffle plate 420, referred to herein as a first set of identical baffle plates. The baffle plates 418 and 420 may be configured to be identical to one another with similar dimensions and features such that a single pattern may be used to manufacture both of the baffle plates 418 and 420. This feature may provide ease of manufacturability by reducing design complexity and manufacturing cost. The first set of identical baffle plates 418, 420 may be unperforated to fluidly isolate the inlet chamber 426 from the second resonant chamber 456, and fluidly separate the outlet chamber 430 from the first resonant chamber 454.

In another aspect, the plurality of baffle plates may further include the baffle plate 422 and the baffle plate 424, referred to collectively as a second set of identical baffle plates. The baffle plates 422 and 424 may be configured to fluidly isolate the plurality of intermediate chambers from the resonant chambers 454 and 456. For example, the baffle plate 422 may be disposed in the housing interior 404 to fluidly isolate the first intermediate chamber 434 from the second resonant chamber 456. As explained previously, full fluid separation (and/or fluid isolation) means that fluid such as the flow of exhaust 410 cannot freely pass from one chamber to another chamber, because the baffle plate does not have perforations that allow gas flow. On the other hand, the center baffle plate 425 may be configured for partial fluid separation such that the flow of exhaust 410 can pass freely with minimal impedance from the second intermediate chamber 436 to the first intermediate chamber 434. The impedance may be due to a perforation pattern having the predetermined ratio of open surface area (e.g., a hole or other opening) to closed surface area (the face of the baffle plate in which the hole or other opening is made) as described with respect to FIGS. 1-3. For example, according to one or more embodiments, the predetermined ratio of open surface area to closed surface can be limited to a range of area values that may be observed to target sound attenuation at higher frequencies. For example, although the six-chamber configuration as depicted in FIG. 4 can attenuate sound at approximately 30 dB or more across lower frequencies (e.g., approximately 0-300 Hz), in some aspects mid-range and high frequencies (e.g., 300-5000 Hz) may be attenuated approximately 30 dB or more when the perforation pattern of the second set of baffles may be at least approximately 28% open area to closed area, and less than or equal to approximately 32% open area to closed area.

The apparatus 400 may further include a first tube 440 configured to direct the flow of exhaust 410 from the inlet chamber 426 to the second intermediate chamber 436 via an interior 442 of the first tube 440. The first tube 440 may extend from and fluidly connect the inlet chamber 426 to the second intermediate chamber 436. In one aspect, the first tube 440 terminates at a surface of the baffle plate 424. The end of the first tube 440 in contact with the baffle plate 424 may be fluidly sealed with the baffle plate 424 at the end of the tube by welding or another method. A portion of the first tube 440 in the second intermediate chamber 436 may incorporate a perforated section 452 having the predetermined ratio of open surface area to closed surface area (described previously with respect to FIGS. 1, 2, and 3). In some aspects, the perforated section 452 may extend around a periphery of the first tube 440 to fluidly connect an interior 442 of the first tube 440 to the second intermediate chamber 436.

Although the first tube 440 may be sealed at the end to the baffle plate 424, an acoustic channel 458 may be formed by an opening (or plurality of openings) in the baffle plate 424 to acoustically connect the interior 442 of the first tube 440 with the first resonant chamber 454. Since the first resonant chamber 454 does not include an outlet to direct the flow of exhaust 410, the first resonant chamber 454 may function as a mid-high frequency sound attenuation chamber. The acoustic channel 458 may include a single hole substantially smaller than an inside diameter of the first tube 440, or a plurality of holes (e.g., such as, for example, the perforation pattern described above).

In another aspect, the apparatus 400 also includes a second tube 444 configured to direct the flow of exhaust 410 from a second one of the plurality of intermediate chambers 434 and/or 436 to the outlet chamber 430 via an interior 446 of the second tube 444. In the embodiment depicted in FIG. 4, the second tube 444 facilitates the flow of exhaust 410 from the first intermediate chamber 434 to the outlet chamber 430 via the interior 446 of the second tube 444. In one aspect, the second tube 444 may terminate at a surface of the baffle plate 422. An end of the second tube 444 in contact with the baffle plate 422 may be fluidly sealed with the baffle plate 422 at the end of the second tube 444 by welding or another method. A portion of the second tube in the first intermediate chamber 434 may incorporated a perforated section 450 having a perforation pattern with the predetermined ratio of open surface area to closed surface area (described previously with respect to FIGS. 1-3). In some aspects, the perforated section 450 may extend around a periphery of the second tube 444 to fluidly connect the interior 446 of the second tube 444 to the first intermediate chamber 434.

Although the second tube 444 may be sealed at the end to the baffle plate 422, an acoustic channel 460 may be disposed in the baffle plate 422 to acoustically connect the interior 446 of the second tube 444 with the second resonant chamber 456. Since the second resonant chamber 456 does not include an outlet to direct the flow of exhaust 410, the second resonant chamber 456 may function as a high frequency sound attenuation chamber that targets low-mid range frequency noise ranging from approximately 100 Hz to approximately 200 Hz. The acoustic channel 460 may include a single hole substantially smaller than a diameter of the second tube 444, or a plurality of holes (e.g., such as, for example, the perforation pattern described above). It should also be appreciated that the relative size of the second resonant chamber 456 is associated with the targeted frequency of sound attenuation. For example, because sound attenuation is associated with size (that is, volume) of the chambers, the larger volume of the second resonant chamber 456 may attenuate lower frequencies (e.g., approximately 0-100 Hz) than the relatively smaller volume of the first resonant chamber 454.

According to embodiments of the present disclosure, and similar to the embodiment described with respect to FIGS. 1-3, the apparatus 400 may incorporate multiple copies of the same part (that is, multiple parts may be identical in that they share the same features and dimensions). For example, the first tube 440 comprises features and dimensions that may be the same as corresponding features and dimensions of the second tube 444, such that multiple copies of the one part can (e.g., the first tube 440) may be copied in another part (e.g., the second tube 444), and the copied part may be oriented different from the first part to produce the described sound attenuation without added complexity of multiple designs for custom parts. In one aspect, the inlet tube 408 may be substantially identical to the outlet tube 412 such that the inlet tube 408 may be shaped, sized, positioned, and/or otherwise configured to mate with and/or accept contiguous parts such that it can substituted for the outlet tube 412, and vice versa. In another aspect, the baffle plate 418 may be substantially identical to the baffle plate 420 such that the baffle plate 418 may be substituted for the baffle plate 420, and vice versa. In one aspect, the inlet tube 408 may be substantially identical to the outlet tube 412 such that the inlet tube 408 may be substituted for the outlet tube 412, and vice versa. In another aspect, the baffle plate 422 may be substantially identical to the baffle plate 424 such that one may be substituted for the other, and vice versa. In yet another aspect, the first tube 440 may be substantially identical to the second tube 444 such that one may be substituted for the other, and vice versa.

The apparatus 400 may further include a sound insulating layer 448 disposed on an interior surface of the housing interior 404, wherein the sound insulating layer may be proximate to the flow of exhaust. The sound insulating layer 448 may be substantially similar and/or identical to the sound insulating layer 448, in that it may provide a thermal and/or acoustic barrier that impedes sound transfer and heat transfer from the housing interior 404 to the housing exterior 406. In one aspect, the sound insulating layer 448 may be configured on an inside surface of the housing interior 404 such that the insulating material may be in direct contact and/or proximate to the flow of exhaust 410.

INDUSTRIAL APPLICABILITY

The present disclosure provides apparatuses for sound attenuation for internal combustion-type motors that target specific frequencies of noise content. According to embodiments of the present disclosure, the apparatuses may attenuate noise to noise reduction levels to approximately 30 dB or more, across a wide spectrum of noise content (e.g., from approximately 0 Hz to approximately 5000 Hz). Moreover, embodiments described herein can minimize cost associated with manufacturing the apparatuses with reduced system complexity, and by incorporation of multiple copies of standardized parts.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An apparatus for engine exhaust sound attenuation comprising:

a housing having an interior and an exterior;

a plurality of baffle plates arranged within the housing, the plurality of baffle plates including at least a first set of matching baffle plates, and a second set of matching baffle plates different from the first set, the plurality of baffle plates being disposed apart from each other to define an inlet chamber at a proximal end of the housing, an outlet chamber at a distal end of the housing, and a plurality of intermediate chambers disposed between the inlet chamber and the outlet chamber, the plurality of intermediate chambers comprising a first intermediate chamber proximate to the inlet chamber, a second intermediate chamber proximate to the first intermediate chamber, and a third intermediate chamber proximate to the second intermediate chamber and the outlet chamber;

an inlet tube disposed fluidly connected to the housing and configured to direct a flow of exhaust from the exterior of the housing to the inlet chamber;

an outlet tube disposed fluidly connected to the housing and configured to direct the flow of exhaust from the outlet chamber to the exterior of the housing;

a first tube configured to direct the flow of exhaust from the inlet chamber to one of the plurality of intermediate chambers via an interior of the first tube; and a second tube configured to direct the flow of exhaust from a second one of the plurality of intermediate chambers to the outlet chamber via an interior of the second tube.

2. The apparatus of claim 1, wherein the first tube comprises a same inner diameter, a same outer diameter, and a same length as the second tube, and wherein the first tube is axially disposed in the interior of the housing parallel to the second tube.

3. The apparatus of claim 2, wherein the first tube is fluidly connected to the inlet chamber, and is configured to direct the flow of exhaust from the inlet chamber to the third intermediate chamber; and the second tube is fluidly connected to the first intermediate chamber, and is configured to direct the flow of exhaust from the first intermediate chamber to the outlet chamber.

4. The apparatus of claim 1, wherein the first set of matching baffle plates comprises a first set of set of identical baffle plates including a first baffle plate configured to fluidly isolate the inlet chamber from the first intermediate chamber, and a second baffle plate configured to fluidly isolate the outlet chamber from the third intermediate chamber.

5. The apparatus of claim 4, wherein the second set of matching baffle plates comprises a second set of identical baffle plates including a third baffle plate and a fourth baffle plate, the second set of identical baffle plates configured to provide partial fluid separation between the plurality of intermediate chambers.

6. The apparatus of claim 5, wherein each baffle plate of the second set of identical baffle plates comprises a perforation pattern configured to provide the partial fluid separation between the plurality of intermediate chambers.

7. The apparatus of claim 6, wherein the perforation pattern comprises a predetermined ratio of open surface area to closed surface area, the predetermined ratio comprising a range of area values comprising at least 28% open area and less than or equal to 32% open area.

8. The apparatus of claim 7, wherein the first tube terminates at a surface of the first baffle plate of the first set of identical baffle plates; and wherein a portion of the first tube disposed in the third intermediate chamber comprises the perforation pattern having the predetermined ratio of open surface area to closed surface area, the perforation pattern extending around a periphery of the first tube to fluidly connect an interior of the first tube to the third intermediate chamber.

9. The apparatus of claim 7, wherein the second tube extends from and fluidly connects the outlet chamber to the first intermediate chamber, wherein the second tube terminates at a surface of the second baffle plate of the first set of identical baffle plates; and wherein a portion of the second tube in the first intermediate chamber comprises the perforation pattern having the predetermined ratio of open surface area to closed surface area, the perforation pattern extending around a periphery of the second tube to fluidly connect an interior of the second tube to the first intermediate chamber.

10. The apparatus of claim 9, wherein the inlet tube terminates at a first surface of the housing interior; and wherein a portion of the inlet tube disposed in the inlet chamber comprises the perforation pattern having the predetermined ratio of open surface area to closed surface area, the perforation pattern extending around a periphery of the inlet tube to fluidly connect an interior of the inlet tube to the inlet chamber.

11. The apparatus of claim 10, wherein the outlet tube terminates at a second surface of the housing interior; and wherein a portion of the outlet tube disposed in the outlet chamber comprises the perforation pattern having the predetermined ratio of open surface area to closed surface area, the perforation pattern extending around a periphery of the outlet tube to fluidly connect an interior of the outlet tube to the outlet chamber.

12. The apparatus of claim 1, wherein at least one of the inlet tube and the outlet tube is disposed substantially perpendicular to a longitudinal axis of the housing.

13. The apparatus of claim 1, further comprising a sound insulating layer disposed on an interior surface of the housing, wherein the sound insulating layer directs at least part of the flow of exhaust as the flow of exhaust passes through the housing.

14. An apparatus for engine exhaust sound attenuation comprising:

a housing having an interior and an exterior;

a plurality of baffle plates arranged within the housing, the plurality of baffle plates including at least a first set of matching baffle plates and a second set of matching baffle plates, different from the first set, the plurality of baffle plates being disposed apart from each other to define an inlet chamber at a proximal end of the housing, an outlet chamber at a distal end of the housing, and a plurality of intermediate chambers disposed between the inlet chamber and the outlet chamber, the plurality of intermediate chambers comprising:

a first resonant chamber proximate to the outlet chamber;

a second resonant chamber proximate to the inlet chamber;

a first intermediate chamber proximate to the second resonant chamber; and a second intermediate chamber proximate to the first intermediate chamber and the first resonant chamber;

an inlet tube disposed fluidly connected to the housing and configured to direct a flow of exhaust from the exterior of the housing to the inlet chamber;

an outlet tube disposed fluidly connected to the housing and configured to direct the flow of exhaust from the outlet chamber to the exterior of the housing;

a first tube configured to direct the flow of exhaust from the inlet chamber to one of the plurality of intermediate chambers via an interior of the first tube; and a second tube configured to direct the flow of exhaust from a second one of the plurality of intermediate chambers to the outlet chamber via an interior of the second tube.

15. The apparatus of claim 14, wherein the first tube comprises a same inner diameter, a same outer diameter, and a same length as the second tube, and wherein the first tube is axially disposed within the housing interior parallel to the second tube.

16. The apparatus of claim 15, wherein the first tube is fluidly connected to the inlet chamber, and is configured to direct the flow of exhaust from the inlet chamber to the second intermediate chamber; and the second tube is fluidly connected to the first intermediate chamber, and is configured to direct the flow of exhaust from the first intermediate chamber to the outlet chamber.

17. The apparatus of claim 14, wherein the first set of matching baffle plates comprises:

a first set of set of identical baffle plates including:

a first baffle plate configured to fluidly isolate the inlet chamber from the second resonant chamber; and a second baffle plate configured to fluidly isolate the outlet chamber from the first resonant chamber; and the second set of matching baffle plates comprises the second set of identical baffle plates including:

a third baffle plate configured to fluidly isolate the second resonant chamber from the first intermediate chamber, and a fourth baffle plate configured to fluidly isolate the first resonant chamber from the second intermediate chamber; and a fifth baffle plate configured to provide partial fluid separation of the first intermediate chamber and the second intermediate chamber, that allows the flow of exhaust from the second intermediate chamber to the first intermediate chamber.

18. The apparatus of claim 17, wherein the fifth baffle plate comprises a perforation pattern having a predetermined ratio of open surface area to closed surface area, the predetermined ratio comprising a range of area values comprising at least 28% open area and less than or equal to 32% open area.

19. The apparatus of claim 18, wherein the first tube terminates at a surface of the first baffle plate of the first set of identical baffle plates, and further comprises an acoustic channel that acoustically connects an interior of the first tube with the first resonant chamber;

wherein a portion of the first tube disposed in the second intermediate chamber comprises the perforation pattern having the predetermined ratio of open surface area to closed surface area, the perforation pattern extending around a periphery of the first tube that fluidly connects the interior of the first tube to the second intermediate chamber;

wherein the second tube terminates at a surface of the second baffle plate of the second set of identical baffle plates, and further comprises an acoustic channel that acoustically connects an interior of the second tube with the second resonant chamber; and wherein a portion of the second tube disposed in the first intermediate chamber comprises the perforation pattern having the predetermined ratio of open surface area to closed surface area, the perforation pattern extending around a periphery of the second tube to fluidly connect the interior of the second tube to the first intermediate chamber.

20. An engine exhaust system comprising:

an engine, and a sound attenuation apparatus connected to an exhaust port of the engine, the sound attenuation apparatus comprising:

a housing having an interior and an exterior;

a plurality of baffle plates arranged within the housing, the plurality of baffle plates including at least a first set of matching baffle plates and a second set of matching baffle plates, different from the first set, the plurality of baffle plates being disposed apart from each other to define an inlet chamber at a proximal end;

an outlet chamber at a distal end of the housing; and a plurality of intermediate chambers disposed between the inlet chamber and the outlet chamber, the plurality of intermediate chambers comprising:

a first resonant chamber proximate to the outlet chamber;

a second resonant chamber proximate to the inlet chamber;

a first intermediate chamber proximate to the second resonant chamber; and a second intermediate chamber proximate to the first intermediate chamber and the first resonant chamber;

an inlet tube disposed fluidly connected to the housing and configured to direct a flow of exhaust from the exterior of the housing to the inlet chamber;

an outlet tube disposed fluidly connected to the housing and configured to direct the flow of exhaust from the outlet chamber to the exterior of the housing;

a first tube configured to direct the flow of exhaust from the inlet chamber to one of the plurality of intermediate chambers via an interior of the first tube; and a second tube configured to direct the flow of exhaust from a second one of the plurality of intermediate chambers to the outlet chamber via an interior of the second tube.

* * * * *